US006021642A

United States Patent [19]

Guinn

[11] Patent Number: 6,021,642

[45] Date of Patent: Feb. 8, 2000

[54] COSMETIC STORAGE AND REFRIGERATION UNIT

[76] Inventor: Bernadette Guinn, 15025 S. Myrtle Ave., Harvey, Ill. 60426

[21] Appl. No.: 09/103,593

[22] Filed: Jun. 24, 1998

[51] Int. Cl.[7] ..... F25D 11/00

[52] U.S. Cl. ..... 62/3.6; 62/235.1

[58] Field of Search ..... 62/3.6, 3.62, 235.1

[56] References Cited

U.S. PATENT DOCUMENTS 4,002,384 1/1977 Brown et al. .
4,326,383 4/1982 Reed et al. .
4,941,327 7/1990 Miles .
4,981,019 1/1991 Hicks et al. ..... 62/3.62
5,301,508 4/1994 Kahl et al. ..... 62/3.62
5,379,596 1/1995 Grayson ..... 62/3.62
5,524,440 6/1996 Nishioka et al. .

*Primary Examiner*—Henry Bennett
*Assistant Examiner*—Melvin Jones
*Attorney, Agent, or Firm*—Michael I. Kroll

[57] ABSTRACT

A cosmetic storage and refrigeration unit (10) comprising an insulated cabinet (12) having a storage chamber (14) for holding various cosmetics and other small articles (16) therein. A system (18) is for lowering the temperature within the storage chamber (14) of the insulated cabinet (12), so as to keep the various cosmetics and other small articles (16) cool, thereby increasing the life expectancy of the various cosmetics and other small articles (16).

16 Claims, 3 Drawing Sheets

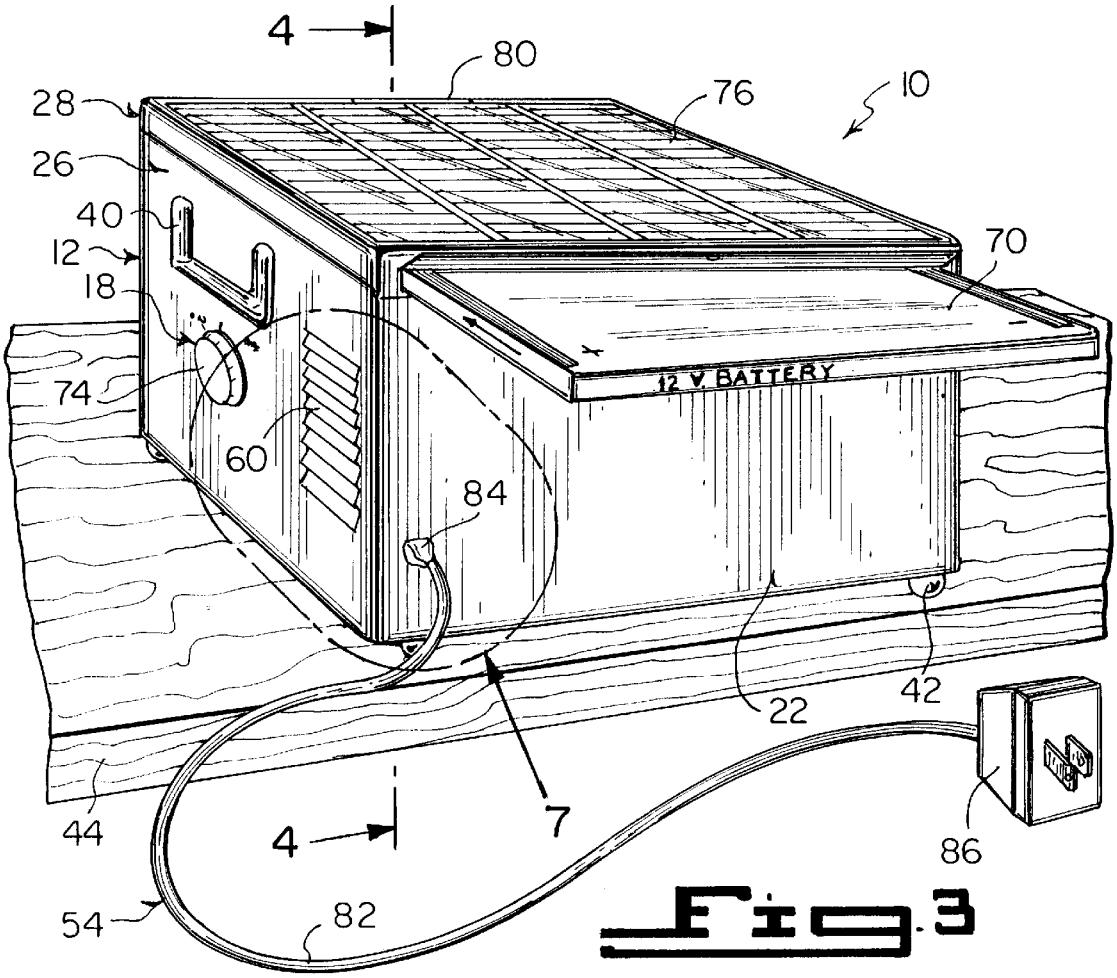
Fig. 3
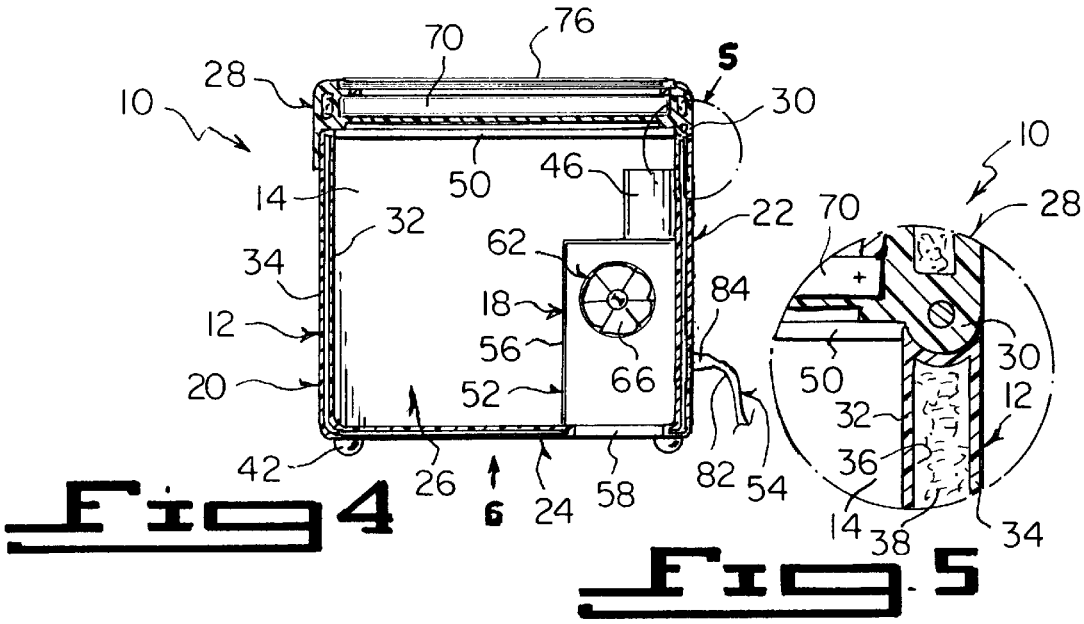
Fig. 4
Fig. 5

COSMETIC STORAGE AND REFRIGERATION UNIT

BACKGROUND OF THE INVENTION

1. Field of the Invention

The instant invention relates generally to compact refrigerators and more specifically it relates to a cosmetic storage and refrigeration unit. The cosmetic storage and refrigeration unit is a coolant cabinet that will increase the life expectancy of various cosmetic and beauty products stored and refrigerated therein. It is also designed to store products that have medical and nutritional value which require refrigeration. The cosmetic storage and refrigeration unit can be conveniently placed in the bedroom or bathroom where beauty regimens are typically done.

2. Description of the Prior Art

Numerous compact refrigerators have been provided in prior art. For example, U.S. Pat. No. 4,002,384 to Brown et al.; U.S. Pat. No. 4,326,383 to Reed et al.; U.S. Pat. No. 4,941,327 to Miles and U.S. Pat. No. 5,524,440 to Nishioka et al. all are illustrative of such prior art. While these units may be suitable for the particular purpose to which they address, they would not be as suitable for the purposes of the present invention as heretofore described.

BROWN, RICHARD C.

SHUSTER, STUART B.

COMPACT REFRIGERATOR COMBINED WITH TOP STORAGE CONTAINER

U.S. Pat. No. 4,002,384

A compact refrigerator cabinet has a top storage container removably retained on its upper wall by means of a U-shaped top trim frame which extends along the front and side edges of the cabinet providing opposed trackways which normally retain a top panel. Flange means are provided on the underside of the container base which are slideably received in the trackways to provide a composite structure. The container has a generally half-round configuration including a concavo-convex top wall extending through a predetermined obtuse angle to define a front access opening. The base wall has a transverse shoulder formed by a notched portion extending inwardly from its front edge and a closure member pivotally supported adjacent the shoulder, whereby the closure may be pivoted downwardly from an upstanding over center position closing the access opening to a horizontal position substantially flush with the cabinet base wall.

REED, KINGSTONE L. H.

HATCHER, IAN

COMPACT THERMOELECTRIC REFRIGERATOR

U.S. Pat. No. 4,326,383

A compact thermoelectric refrigerator includes a storage compartment, the lower portion of which is lined with a thin, high-conductivity aluminum liner which functions as an internal heat exchanger. The storage compartment is separated by means of a dividing wall from a compartment containing a thermoelectric module, a low profile, high density external heat exchanger including an extruded high thermal conductivity aluminum base and a plurality of closely spaced high thermal conductivity fins attached to the base by means of thermal epoxy, and a centrifugal fan disposed above the external heat exchanger and driven by a fan motor disposed in a recess in a wall of the thermoelectric refrigerator. Outside air is drawn by the centrifugal fan through an air intake grill located in the upper portion of an end panel and is forced through the fins of the external heat exchanger and out of an air outlet grill located along the lower edge of the end panel. The thermoelectric module is in thermal contact with the lower portion of the side of the aluminum liner, and conducts heat away from the aluminum liner to the external heat exchanger. The thickness and conductivity of the aluminum liner is such that a predetermined temperature gradient exists from one end of the storage compartment to the other end thereof.

MILES, MILTON C.

COMPACT FOOD PACKAGE DISPLAY REFRIGERATOR

U.S. Pat. No. 4,941,327

A compact retail display refrigerator for displaying refrigerated food packages maintained at super chilled temperature comprises a small cabinet with a refrigerated upper compartment containing a row array of package guideways formed of a plurality of vertically extending guide pins upstanding from a perforated base support plate. Self acting spring loaded lift devices mounted within the guideways support stacks of food packages therein and urge them upwardly step-by-step to automatically locate the existing topmost package in each stack at a predetermined selection level. Refrigerating mechanism located within a lower compartment of the cabinet includes a pair of cooling coils having alternately operating cooling and defrosting cycles and mounted in a bottom cooling chamber portion of the cabinet, and an electric fan forces the cooled air from the cooling chamber upwardly through a vertical duct at the back of the cabinet and having a forwardly directed side outlet opening at its top end for directing a stream of the chilled air forwardly across the top of the row array of package stacks and downwardly therebetween and through the perforated base support plate back into the cooling chamber.

NISHIOKA, HAJIME

AMANO, SHIRO

TSUMURA, NORIAKI

COMPACT REFRIGERATOR FOR COSMETICS

U.S. Pat. No. 5,524,440

The present invention relates to a compact refrigerator for exclusively storing cosmetic preparations and certain kinds of medicines. Particularly, it relates to a compact refrigerator for storing in the compartment thereof cosmetic preparations not containing any chemical preservative or disinfectant that may have a bad effect on a human body, or cosmetic preparations containing any such preservative or disinfectant only in a small amount, so that any effect produced by the preservative or disinfectant on a human body may be minimized. The refrigerator maintains the temperature in the compartment thereof within a temperature range of about five degrees through ten degrees and keeps them cool. The present invention maintains the temperature in the compartment of the refrigerator within a predetermined range of temperature by means of a thermoelectric module such as a Peltier element and/or a heat dissipating fan.

SUMMARY OF THE INVENTION

A primary object of the present invention is to provide a cosmetic storage and refrigeration unit that will overcome the shortcomings of the prior art devices.

Another object is to provide a cosmetic storage and refrigeration unit that will increase the life expectancy of nail polish, perfumes, mascara and hair relaxers stored and refrigerated therein, while also designed for storage of products that have medical and nutritional value which require refrigeration, such as herbal extracts, vitamins and medication.

An additional object is to provide a cosmetic storage and refrigeration unit that will store and refrigerate beauty products, such as eye gels and hair relaxers, at the immediate disposal in the bedroom or the bathroom where beauty regimens are typically done, rather than storage in the kitchen refrigerator where beauty regimens seldom take place.

A further object is to provide a cosmetic storage and refrigeration unit that is simple and easy to use.

A still further object is to provide a cosmetic storage and refrigeration unit that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 3 is a rear perspective view of the present invention with the insulated lid closed and the battery being installed.

FIG. 4 is a cross sectional view taken along line 4—4 in FIG. 3.

FIG. 5 is an enlarged cross sectional detail view as indicated by arrow 5 in FIG. 4.

Similar reference characters denote corresponding features consistently throughout the attached drawings.

DESCRIPTION OF THE PREFERRED EMBODIMENTS

Figure 1:
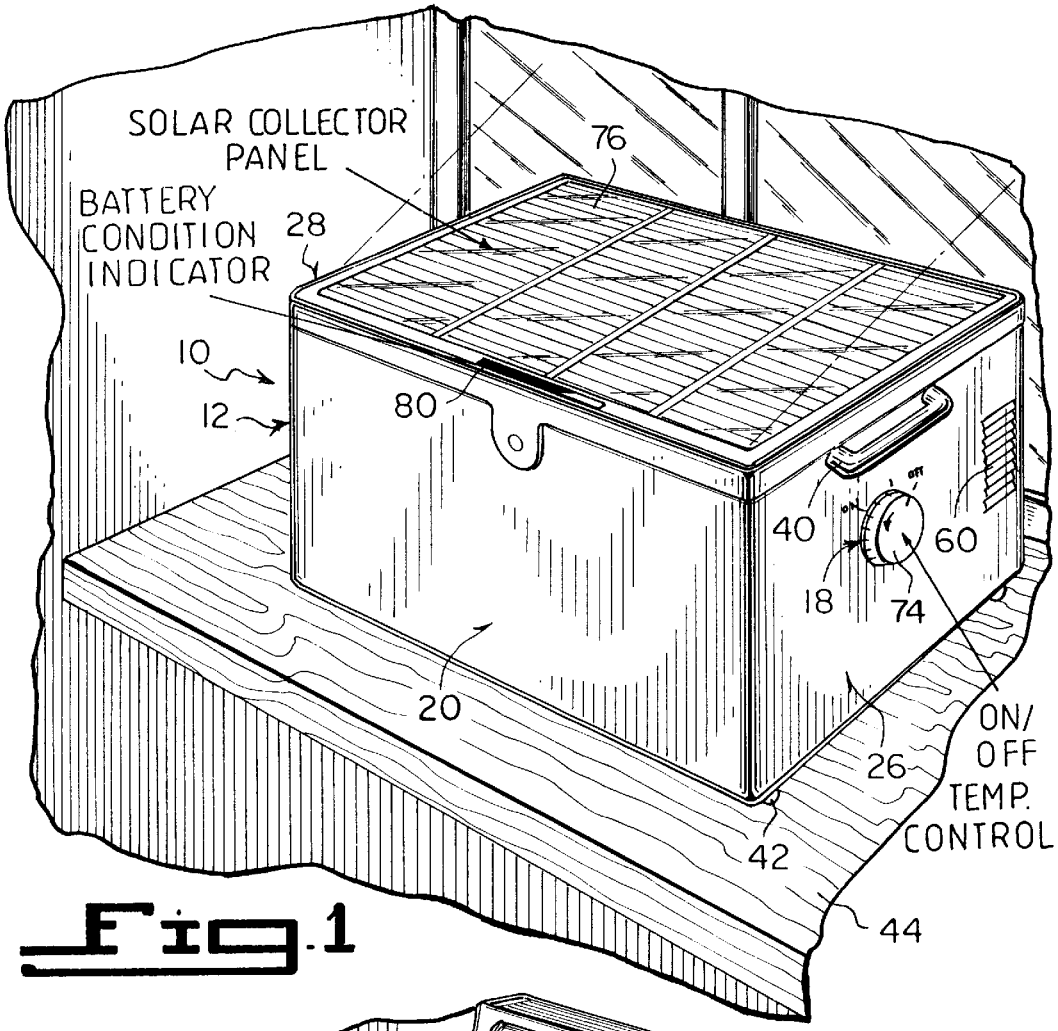
FIG. 1 is a front perspective view of the present invention with the insulated lid closed.
Figure 2:
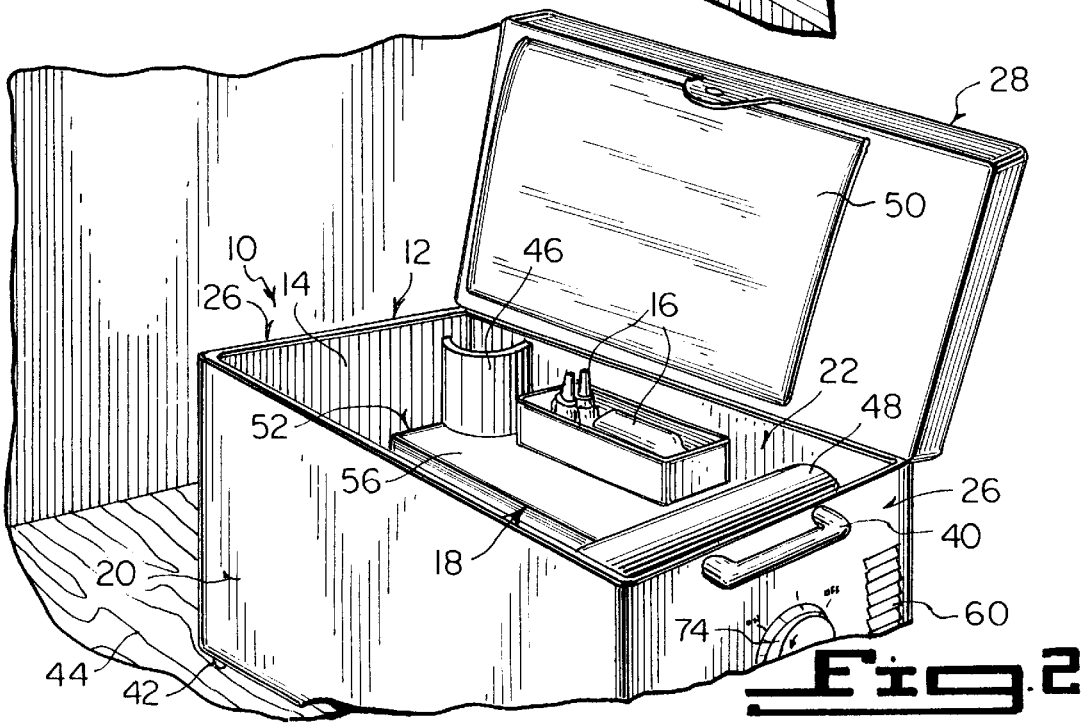
FIG. 2 is a front perspective view of the present invention with parts broken away and the insulated lid opened.
Figure 6:
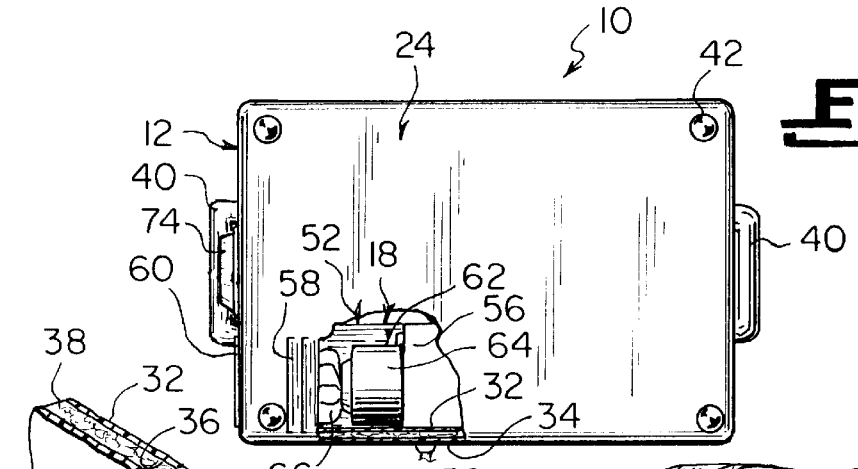
FIG. 6 is a bottom view taken in the direction of arrow 6 in FIG. 4, with the insulated bottom wall broken away.
Figure 7:
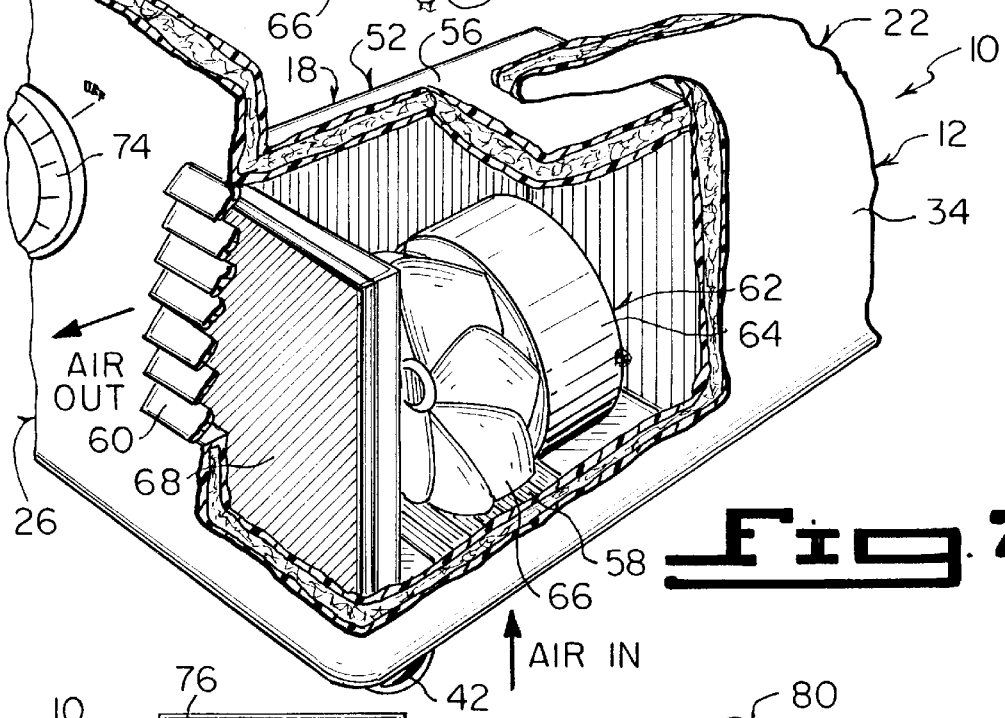
FIG. 7 is an enlarged rear perspective view of an area in FIG. 3 as indicated by arrow 7, with parts broken away and in section.
Figure 8:
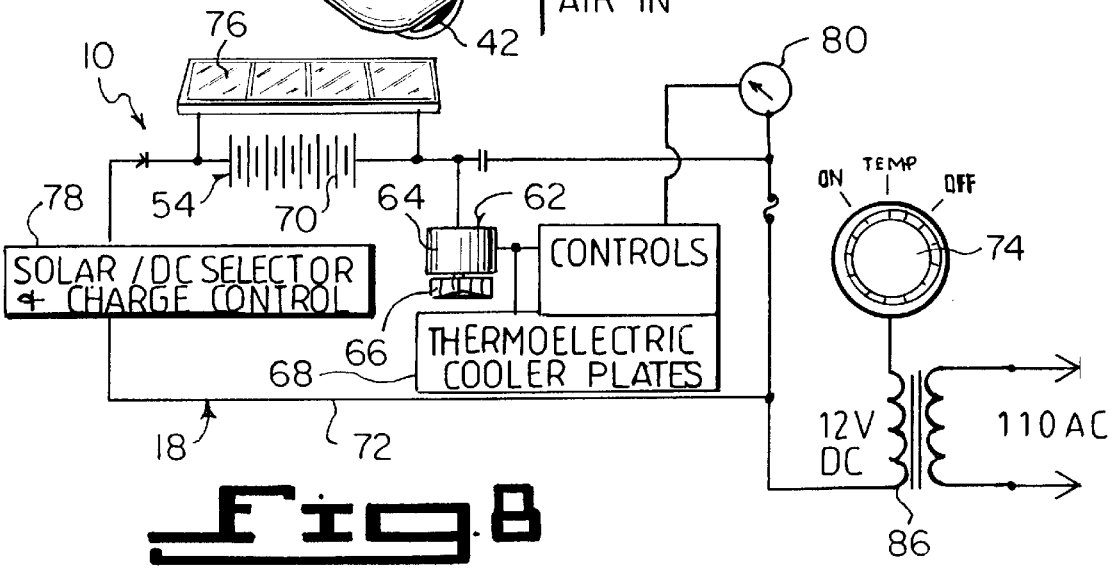
FIG. 8 is a schematic diagram of the electrical circuitry thereof.

Turning now descriptively to the drawings, in which similar reference characters denote similar elements throughout the several views, FIGS. 1 through 8 illustrate the present invention being a cosmetic storage and refrigeration unit. With regard to the reference numerals used, the following numbering is used throughout the various drawing figures.

| | |
|---|---|
| 10 | cosmetic storage and refrigeration unit |
| 12 | insulated cabinet of 10 |
| 14 | storage chamber in 12 |
| 16 | cosmetics and small articles |
| 18 | temperature lowering system of 10 |
| 20 | insulated front wall of 12 |
| 22 | insulated rear wall of 12 |
| 24 | insulated bottom wall of 12 |
| 26 | insulated side wall of 12 |
| 28 | insulated lid of 12 |
| 30 | hinge between 22 and 28 |
| 32 | inner liner of 20, 22, 24, 26 and 28 |
| 34 | outer skin of 20, 22, 24, 26 and 28 |
| 36 | narrow channel way between 32 and 34 |
| 38 | thermal insulation material in 36 |
| 40 | carry handle on 26 |
| 42 | foot on 24 |
| 44 | horizontal support surface |
| 46 | vertical storage compartment in 14 |
| 48 | horizontal storage tray in 14 |
| 50 | eye mask pocket on 28 |
| 52 | thermoelectric cooling device of 18 |
| 54 | electricity supplying facility of 18 |
| 56 | insulated enclosure of 52 |
| 58 | air inlet vent of 52 |
| 60 | air outlet vent of 52 |
| 62 | cooling fan of 52 |
| 64 | electric motor of 62 |
| 66 | fan blade of 62 |
| 68 | thermoelectric cooler plate of 62 |
| 70 | battery of 54 |
| 72 | electric circuit of 54 |
| 74 | on/off temperature control dial of 54 |
| 76 | solar collector panel of 54 |
| 78 | solar/DC selector and charge control circuit of 54 |
| 80 | battery condition indicator of 54 |
| 82 | power cord of 54 |
| 84 | plug of 54 on 82 |
| 86 | transformer plug of 54 on 82 |

The cosmetic storage and refrigeration unit 10 comprises an insulated cabinet 12 having a storage chamber 14, for holding various cosmetics and other small articles 16 therein. A system 18 is for lowering the temperature within the storage chamber 14 of the insulated cabinet 12, so as to keep the various cosmetics and other small articles 16 cool, thereby increasing the life expectancy of the various cosmetics and other small articles 16.

The insulated cabinet 12 includes an insulated front wall 20, an insulated rear wall 2, an insulated bottom wall 24 and a pair of insulated side walls 26, so as to form the storage chamber 14 therein. An insulated lid 28 is hinged at 30 along a top portion of the insulated rear wall 22, for covering the storage chamber 14.

The insulated front wall 20, rear wall 22, bottom wall 24, side walls 26 and the insulated lid 28 each includes an inner liner 32. An outer skin 34 is spaced slightly away from the inner liner 32, to form a narrow channel way 36 therebetween. Thermal insulation material 38 is filled within the narrow channel way 36.

The insulated cabinet 12 contains a pair of carry handles 40, each mounted to one insulated side wall 26, so that a person can grasp the carry handles 40 to transport the insulated cabinet 12 from place to place. A plurality of feet 42 are mounted to the underside of the insulated bottom wall 24, so as to elevate the insulated bottom wall 24 slightly above a horizontal support surface 44 the feet 42 are placed upon.

The insulated cabinet 12 includes a vertical storage compartment 46 formed within a rear corner of the storage chamber 14, for holding mascara and other similar articles therein. A horizontal storage tray 48 is mounted within the storage chamber 14, for holding nail polish and eye gels therein. An eye mask pocket 50 is secured to the underside of the insulated lid 28.

The temperature lowering system 18 includes a thermoelectric cooling device 52 provided in the insulated cabinet 12. A facility 54 is for supply electricity to the thermoelectric cooling device 52 for operation of same.

The thermoelectric cooling device 52 includes an insulated enclosure 56 within the storage chamber 14 of the insulated cabinet 12. An air inlet vent 58 is located through the insulated bottom wall 24 and into the insulated enclosure 56. An air outlet vent 60 is located through one of the insulated side walls 26 and into the insulated enclosure 56. A cooling fan 62 having an electric motor 64 and fan blades 66 is mounted within the insulated enclosure 56. A pair of thermoelectric cooler plates 68 are mounted within the insulated enclosure 56 between the air outlet vent 60 and the fan blades 66 of the cooling fan 62.

The electricity supplying facility 54 consists of a battery 70 removably mounted within the insulated lid 28. An electric circuit 72 is for connecting the battery 70 to the electric motor 64 of the cooling fan 62. An on/off temperature control dial 74 is mounted on an exterior surface of one of the insulated side walls 26 and is electrically connected into the electric circuit 72.

A solar collector panel 76 is mounted onto an exterior surface of the insulated lid 28 and is electrically connected to the electric circuit 72 for charging the battery 70. A solar/DC selector and charge control circuit 78 is electrically connected to the electric circuit 72. A battery condition indicator 80 is mounted onto the exterior surface of the insulated lid 28 adjacent the solar collector panel 76, and is electrically connected to the electric circuit 72.

The electricity supply facility 54 further contains a power cord 82. A plug 84 is on a first end of the power cord 82, to electrically connect into the electric circuit 72. A transformer plug 86 is on a second end of the power cord 82 to engage with a wall socket, so as to convert 110 AC current into 12 V DC current, to bypass the battery 70 and operate the electric motor 64 of the cooling fan 62.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A cosmetic storage and refrigeration unit comprising:

a) an insulated cabinet having a storage chamber for holding various cosmetics and other small articles therein, said insulated cabinet including i) an insulated front wall;

ii) an insulated rear wall;

iii) an insulated bottom wall;

iv) a pair of insulated side walls, so as to form said storage chamber therein; and v) an insulated lid hinged along a top portion of said insulated rear wall for covering said storage chamber; and b) means for lowering the temperature within said storage chamber of said insulated cabinet, so as to keep the various cosmetics and other small articles cool, thereby increasing the life expectancy of the various cosmetics and other small articles, said temperature lowering means including:

i) a thermoelectric cooling device provided in said insulated cabinet, said thermoelectric cooling device including an insulated enclosure within said storage chamber of said insulated cabinet; an air inlet vent located through said insulated bottom wall and into said insulated enclosure; an air outlet vent located through one of said insulated side walls and into said insulated enclosure; a cooling fan having an electric motor and fan blades mounted within said insulated enclosure; and a pair of thermoelectric cooler plates mounted within said insulated enclosure between said air outlet vent and said fan blades of said cooling fan; and ii) means for supplying electricity to said thermoelectric cooling device for operation of same, said means for supplying including a battery removably mounted within said insulated lid; an electric circuit for connecting said battery to said electric motor of said cooling fan; and an on/off temperature control dial mounted on an exterior surface of one of said insulated side walls and electrically connected in to said electric circuit.

2. A cosmetic storage and refrigeration unit as recited in claim 1, wherein said insulated front wall, rear wall, bottom wall and side walls and said insulated lid each includes:

a) an inner liner;

b) an outer skin spaced slightly away from said inner liner to form a narrow channel way therebetween; and c) thermal insulation material filled within said narrow channel way.

3. A cosmetic storage and refrigeration unit as recited in claim 2, wherein said cabinet includes a pocket secured to the underside of said insulated lid.

4. A cosmetic storage and refrigeration unit as recited in claim 1, wherein said insulated cabinet includes a pair of carry handles each mounted to one said insulated side wall, so that a person can grasp said carry handles to transport said insulated cabinet from place to place.

5. A cosmetic storage and refrigeration unit as recited in claim 1, wherein said cabinet includes a plurality of feet mounted to the underside of said insulated bottom wall, so as to elevate said insulated bottom wall slightly above a horizontal support surface said feet are placed upon.

6. A cosmetic storage and refrigeration unit as recited in claim 1, wherein said insulated cabinet includes a vertical storage compartment formed within a rear corner of said storage chamber, for holding mascara and other similar articles therein.

7. A cosmetic storage and refrigeration unit as recited in claim 1, wherein said cabinet includes a horizontal storage tray mounted within said storage chamber, for holding nail polish and eye gels therein.

8. A cosmetic storage and refrigeration unit as recited in claim 1, wherein said electricity supplying means further includes:

a) a solar collector panel mounted onto an exterior surface of said insulated lid and electrically connected to said electric circuit for charging said battery;

b) a solar/DC selector and charge control circuit electrically connected to said electric circuit; and c) a battery condition indicator mounted onto the exterior surface of said insulated lid adjacent said solar collector panel and electrically connected to said electric circuit.

9. A cosmetic storage and refrigeration unit as recited in claim 1, wherein said electricity supply means further includes:

a) a power cord;

b) a plug on a first end of said power cord to electrically connect into said electric circuit; and c) a transformer plug on a second end of said power cord to engage with a wall socket, so as to convert 110 AC current into 12 V DC current, to bypass said battery and operate said electric motor of said cooling fan.

10. A cosmetic storage and refrigeration unit as recited in claim 2, wherein said insulated cabinet includes a pair of carry handles each mounted to one said insulated side wall, so that a person can grasp said carry handles to transport said insulated cabinet from place to place.

11. A cosmetic storage and refrigeration unit as recited in claim 10, wherein said cabinet includes a plurality of feet mounted to the underside of said insulated bottom wall, so as to elevate said insulated bottom wall slightly above a horizontal support surface said feet are placed upon.

12. A cosmetic storage and refrigeration unit as recited in claim 11, wherein said insulated cabinet includes a vertical storage compartment formed within a rear corner of said storage chamber, for holding mascara and other similar articles therein.

13. A cosmetic storage and refrigeration unit as recited in claim 12, wherein said cabinet includes a horizontal storage tray mounted within said storage chamber, for holding nail polish and eye gels therein.

14. A cosmetic storage and refrigeration unit as recited in claim 13, wherein said cabinet includes a pocket secured to the underside of said insulated lid.

15. A cosmetic storage and refrigeration unit as recited in claim 14, wherein said electricity supplying means further includes:

a) a solar collector panel mounted onto an exterior surface of said insulated lid and electrically connected to said electric circuit for charging said battery;

b) a solar/DC selector and charge control circuit electrically connected to said electric circuit; and c) a battery condition indicator mounted onto the exterior surface of said insulated lid adjacent said solar collector panel and electrically connected to said electric circuit.

16. A cosmetic storage and refrigeration unit as recited in claim 15, wherein said electricity supply means further includes:

a) a power cord;

b) a plug on a first end of said power cord to electrically connect into said electric circuit; and c) a transformer plug on a second end of said power cord to engage with a wall socket, so as to convert 110 AC current into 12V DC current, to bypass said battery and operate said electric motor of said cooling fan.

* * * * *